United States Patent [19]

Gunn

[11] 4,295,701

[45] Oct. 20, 1981

[54] ELECTRICAL CONNECTOR FOR SUBMARINE REPEATERS OR THE LIKE

[75] Inventor: Duncan A. Gunn, Saffron Walden, England

[73] Assignee: International Standard Electric Corporation, New York, N.Y.

[21] Appl. No.: 71,876

[22] Filed: Sep. 4, 1979

[30] Foreign Application Priority Data

Sep. 7, 1978 [GB] United Kingdom ..... 35914/78

[51] Int. Cl.[3] ..... H01R 13/52

[52] U.S. Cl. ..... 339/94 A; 339/117 R

[58] Field of Search ..... 339/93 R, 93 C, 94 R, 339/94 M, 94 A, 64 R, 64 M, 126 R, 126 RS, 132 R, 132 B, 117 R, 117 P; 174/151

[56] References Cited

U.S. PATENT DOCUMENTS

| | | | |
|---|---|---|---|
| 2,289,164 | 7/1942 | Arnold et al. | 174/151 |
| 2,374,403 | 4/1945 | Yarnall | 85/50 R |
| 2,991,441 | 7/1961 | Butler | 339/126 RS |
| 3,022,484 | 2/1962 | Thompson, Jr. | 339/94 M |
| 3,187,292 | 1/1965 | Small et al. | 339/94 A |
| 3,488,623 | 6/1970 | Stephenson et al. | 339/132 B |

*Primary Examiner*—Neil Abrams

*Attorney, Agent, or Firm*—William T. O'Neil

[57] ABSTRACT

A demountable plug/socket connector assembly for making an electrical connection across a high pressure differential between the surfaces of a bulkhead such as the housing wall of a submarine repeater. One sub-assembly, ordinarily the socket sub-assembly is mounted in a bore or aperture on the low pressure side of the bulkhead, the mounting being resilient so that a small amount of engagement overtravel of the mating plug sub-assembly inserted through the bore resiliently disengages a seal between the socket member and the bulkhead to permit the inert gas on the low pressure side of the bulkhead to flow into the interface volume surrounding the pin/socket connection effected by mating of the plug/socket assembly. A second seal enables as the plug member is firmly seated, to exclude the high pressure medium (sea water for example) from entering the interface volume. The operation of the seals is reversible upon detachment.

4 Claims, 1 Drawing Figure

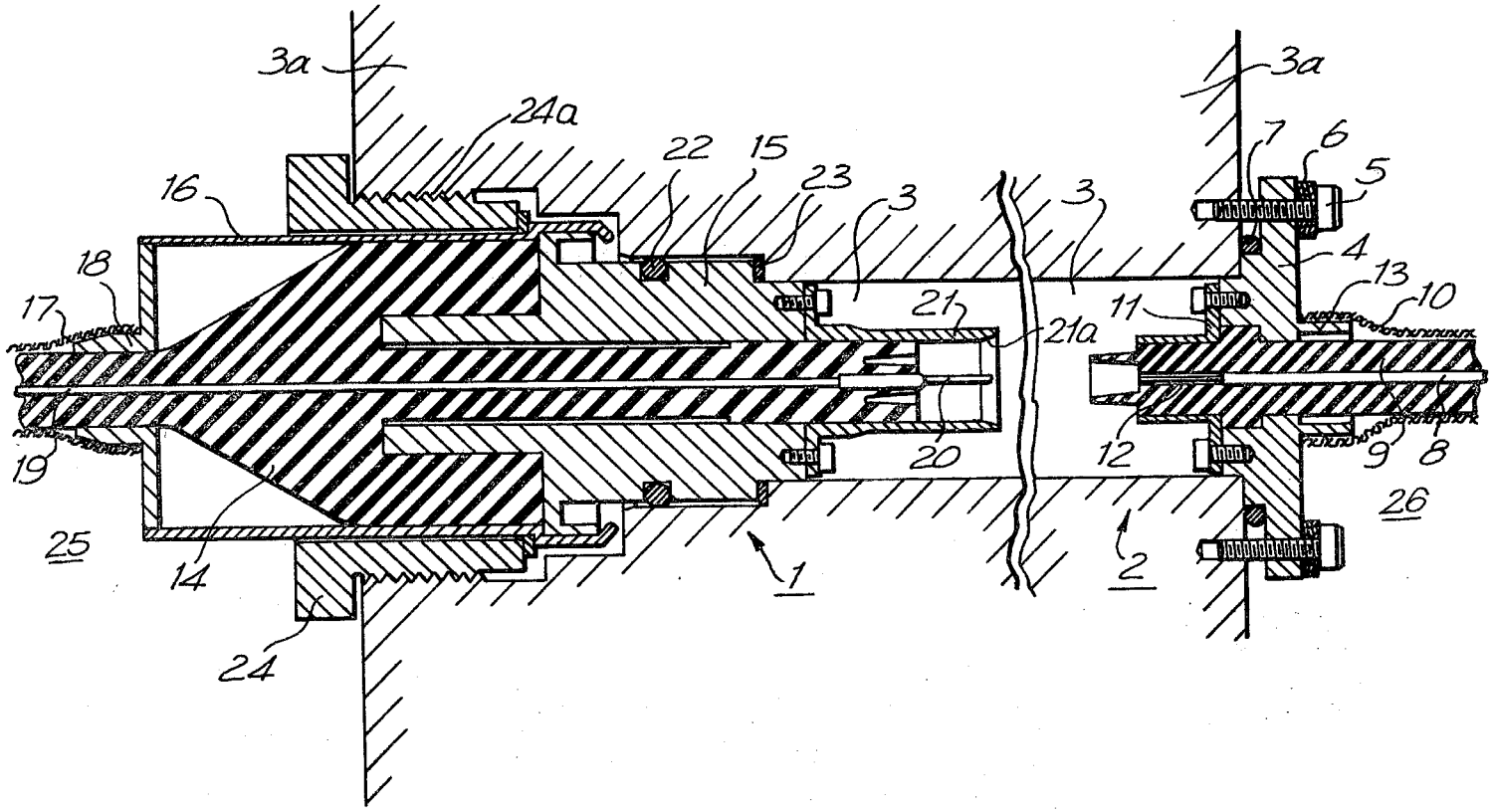
3a
7
6
5
4
13
10
8
9
26
11
12
2
3
21a
21
20
3
23
15
22
1
24a
3a
16
18
17
19
25
14
24

ELECTRICAL CONNECTOR FOR SUBMARINE REPEATERS OR THE LIKE

BACKGROUND OF THE INVENTION

This invention relates to demountable plug and socket electrical connectors for use where electrical connections are to be made through a bulkhead on one side of which is a low pressure inert gas atmosphere and on the other side of which there is a high pressure environment.

In the prior art, various arrangements for sealing plug/socket combinations in extreme environments, such as encountered in submarine cabling, have been suggested and employed. For example, where submarine repeaters are used there is need to connect input and output cables (coaxial type in modern submarine cabling systems) to the housing. Although neither attachment nor detachment are undertaken under water, the need exists for periodic repair or maintenance of repeater or similar apparatus necessitating disconnection and reconnection.

It is known to fill the enclosures of submarine repeaters, etc., with an inert gas for reasons well understood in the art. There is need for a simpler and relatively low cost insertion-operated device for automatically including the actual pin/socket interface within the inert gas atmosphere extant within the repeater housing. The manner in which the present invention provides a unique apparatus for that will be evident as this description proceeds.

SUMMARY OF THE INVENTION

According to the invention there is provided a demountable connector arrangement mountable in an aperture through a bulkhead the connector comprising plug and socket portions, one of which is provided with elastomeric sealing means between that portion and the surface of the bulkhead and is affixed to the bulkhead by spring tensioned means, the other portion having at least part thereof shaped for insertion into the aperture and being provided with sealing means between the shaped part and the bore of the aperture, the other portion also having clamping means for clamping it securely within the bore, the dimensions of the two portions being such that partial insertion of the other portion into the aperture results in electrical connections between the two portions, followed by sealing of the other portion within the bore of the aperture, and complete insertion of the other part results in the one part being forced against the spring tensioned means sufficient to disengage the elastomeric sealing means.

BRIEF DESCRIPTION OF THE DRAWING

A single FIGURE is presented depicting a plug/-socket arrangement according to the invention in an axially sectional view.

DETAILED DESCRIPTION

An embodiment of the invention will now be described with reference to the accompanying drawing.

The connector assembly has a plug portion 1 and a socket portion 2 designed for connecting a coaxial cable through a bulkhead. The plug portion 1 is on the high pressure side 25 side of bulkhead 3*a* and the socket portion is on the low pressure side 26 where an inert gas atmosphere is maintained.

The socket portion 2 has a flanged member 4 which is secured to one end of an aperture 3 in the bulkhead 3*a* by screws 5 and screw tensioning springs 6. The springs 6 are themselves in compression as they are in place. The flanged member 4 is spaced from the surface of the bulkhead by an elastomeric sealing ring 7 which, when the plug portion is disengaged, is compressed between the flanged member and the bulkhead by the springs 6. The flanged member 4 has passing through its center the end of a coaxial line consisting of center conductor 8, dielectric sheath 9 and outer conductor 10. The end of the coaxial line and sheath 9 as a unit are clamped in place by a clamping ring 11 and the center conductor 8 is terminated in an electrical socket member 12. The coaxial cable outer conductor 10 is electrically secured to an annular portion 13 of the flanged member 4. Although in the arrangement shown, the outer conductor is braided, cables with non-braided outer conductors can be similarly joined at 13.

The plug portion 1 consists of a moulded dielectric sheath section 14, a generally tubular metal body 15 surrounding part of the sheath and a housing shell 16. The outer conductor 17 of the high pressure and coaxial cable is electrically bonded (soldered or brazed for example) to an annular portion 18 of the housing shell 16. The coaxial cable center 19 terminates in a connector pin 20 which is shrouded by a metal tubular extension 21 fixed to the body 15. The body 15 has an annular shoulder in which is located an elastomeric sealing ring 23 which abuts a facing shoulder in the bulkhead bore. The bulkhead bore is exaggerated in axial length to permit showing the plug and socket sub-assemblies 1 and 2 as they would be installed in the bulkhead but not mated. Actually the axial length of bore 3 is such as to permit mating and a small overtravel as the gland nut 24 is turned against threads 24*a* to seat the plug sub-assembly 1.

During engagement, the internal chamfer 21*a* guides the axially extending surface of 11 to cause pin 20 to fully engage socket member 12 before the axial movement of socket sub-assembly 1 reaches "hard" contact at the mating of the end surfaces of the two dielectric sheaths 9 and 14.

The aforementioned overtravel movement of the plug 1 pushes the flanged member of the socket 2 away from the bulkhead disengaging the seal provided by elastomeric sealing ring 7 and allowing the inert gas atmosphere 26 to enter the bore 3 surrounding the electrical connections. At the same time, the final movement of the plug sub-assembly 1 results in the soft metal sealing ring 23 being compressed to provide the required sealing of the electrical connections from the high pressure medium 25.

When the plug portion 1 is removed the reverse sequence of operations takes place. Initially the sealing action of the ring 7 is restored, the sealing action of the rings 23 and then 22 are discontinued and finally the electrical connection is broken.

Modifications and variations will suggest themselves to those skilled in this art and, accordingly, it is not intended that the scope of the invention should be regarded as limited by the drawing of this description.

What is claimed is:

1. A detachable electrical connector assembly including a pair of mateable connector sub-assemblies providing an electrical connection between separated high and low fluid pressure environments, the combination comprising:

a bulkhead separating said high and low pressure fluid environments and having an aperture therethrough;

a first connector assembly;

first means for mounting said first connector sub-assembly partially through said bulkhead aperature and adjacent the low pressure side of said bulkhead, said first means including means providing a resilient compressive retaining force between a surface of the body of said first connector sub-assembly and the surface of said bulkhead low pressure side when said sub-assemblies are not mated;

second means including a first seal compressed between said first connector sub-assembly body surface and said bulkhead low pressure side in response to said retaining force, an inert gas present against said low pressure side of said bulkhead;

a second connector assembly mateable from the high pressure side of said bulkhead into said first connector assembly, the dimensions of said bulkhead and said connectors being such that, upon mating of said connector assemblies said first connector overtravels against said resilient compressive retaining force to an extent permitting said inert gas to readily flow past said first seal into the volume surrounding the electrical connection between said connector assemblies, said first seal being restored by said resilient compressive force to retain said low pressure fluid when said second connector sub-assembly is withdrawn to break said electrical connection.

2. Apparatus according to claim 1 further comprising a second seal engaged by a portion of said second connector sub-assembly and compressed against said high pressure side of said bulkhead to seal said volume surrounding said electrical connection from said high pressure environment when said second connector assembly is substantially fully mated with said first connector sub-assembly.

3. Apparatus according to claim 2 in which said first seal is an elastomeric ring and said second seal is a soft metal ring.

4. Apparatus according to claim 3 in which said second connector sub-assembly includes means engageable with said bulkhead to hold said second connector sub-assembly into substantially full mating with said first connector sub-assembly.

* * * * *